US006971132B2

(12) United States Patent
Feinsod

(10) Patent No.: US 6,971,132 B2
(45) Date of Patent: Dec. 6, 2005

(54) MATTRESS WITH HAND SUPPORTS

(76) Inventor: Fred M. Feinsod, 9 Alta Vista Rd., Colorado Springs, CO (US) 80906

( * ) Notice: Subject to any disclaimer, the term of this patent is extended or adjusted under 35 U.S.C. 154(b) by 0 days.

(21) Appl. No.: 10/730,529

(22) Filed: Dec. 8, 2003

(65) Prior Publication Data

US 2005/0055777 A1 Mar. 17, 2005

Related U.S. Application Data

(60) Provisional application No. 60/503,258, filed on Sep. 16, 2003.

(51) Int. Cl.[7] ..... A47C 21/08
(52) U.S. Cl. ..... 5/703 Q; 5/424; 5/425
(58) Field of Search ..... 5/703, 424–425, 5/658, 659, 662

(56) References Cited

U.S. PATENT DOCUMENTS

| | | | | |
|---|---|---|---|---|
| 1,432,875 | A | 10/1922 | Lavagetto | |
| 1,925,637 | A | 9/1933 | Kellar | |
| 2,703,415 | A * | 3/1955 | Bechik | 5/703 |
| 3,803,646 | A | 4/1974 | Newerowski | |
| 3,837,020 | A | 9/1974 | Bosch | |
| 3,844,471 | A * | 10/1974 | Hind | 229/101 |
| 4,016,612 | A | 4/1977 | Barile, Sr. | |
| 4,286,344 | A * | 9/1981 | Ikeda | 5/717 |
| 4,370,765 | A | 2/1983 | Webber | |
| 4,439,880 | A | 4/1984 | Koncelik et al. | |
| 4,712,258 | A | 12/1987 | Eves | |
| 4,782,864 | A | 11/1988 | Abildskov | |
| 4,980,940 | A | 1/1991 | Isshiki | |
| 4,998,308 | A | 3/1991 | Farago | |
| 5,077,843 | A | 1/1992 | Dale et al. | |
| 5,179,744 | A | 1/1993 | Foster et al. | |
| 5,191,663 | A | 3/1993 | Holder et al. | |
| 5,437,067 | A | 8/1995 | Bernstein et al. | |
| 5,471,689 | A | 12/1995 | Shaw et al. | |
| 5,515,549 | A * | 5/1996 | Wang | 5/625 |
| 5,689,839 | A | 11/1997 | Laganiere et al. | |
| 5,701,619 | A | 12/1997 | Ullman | |
| 5,963,998 | A | 10/1999 | Carew et al. | |
| 6,067,678 | A * | 5/2000 | Trevino | 5/628 |
| 6,182,310 | B1 | 2/2001 | Weismiller et al. | |
| 6,240,580 | B1 | 6/2001 | Hamilton et al. | |
| 6,243,894 | B1 | 6/2001 | Kosumsuppamala et al. | |
| 6,256,822 | B1 | 7/2001 | Weston et al. | |
| 6,324,709 | B1 | 12/2001 | Ikeda et al. | |
| 6,401,277 | B1 | 6/2002 | Savage et al. | |
| 6,401,281 | B1 | 6/2002 | Younge | |
| 6,427,264 | B1 | 8/2002 | Metz et al. | |
| 6,430,763 | B2 | 8/2002 | Kosumsuppamala et al. | |
| 6,739,001 | B2 * | 5/2004 | Flick et al. | 5/425 |
| 2001/0003789 | A1 * | 6/2001 | Dutto et al. | 600/415 |
| 2001/0027576 | A1 | 10/2001 | Kosumsuppamala et al. | |
| 2002/0170117 | A1 | 11/2002 | Flick et al. | |

* cited by examiner

*Primary Examiner*—Heather Shackelford
*Assistant Examiner*—Fredrick Conley
(74) *Attorney, Agent, or Firm*—Dorr, Carson, Sloan, Birney & Kramer, P.C.

(57) ABSTRACT

A mattress for use in hospital, nursing homes, and the like, incorporates hand supports with hand grips built into the sides of the mattress. Raised bolsters built into the top surface of the mattress adjacent to its lateral edges help to prevent the patient from falling out of the bed.

13 Claims, 5 Drawing Sheets

Fig. 5A
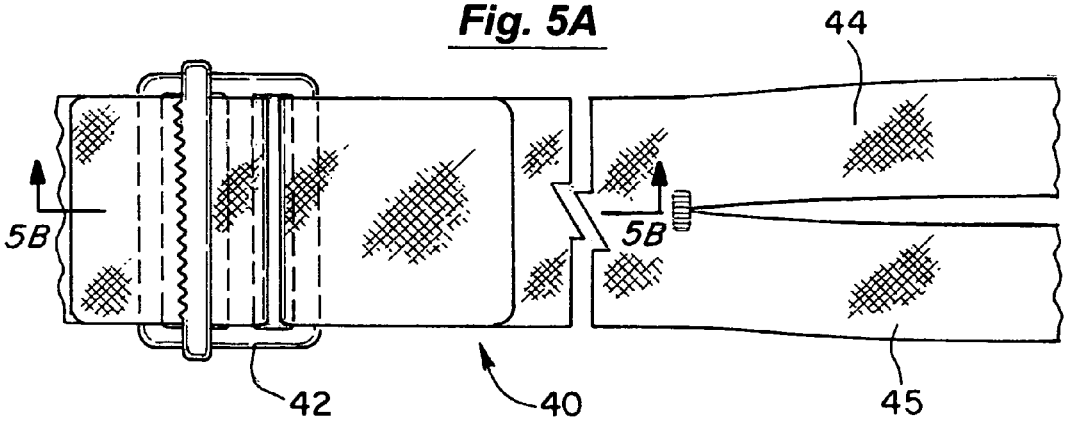
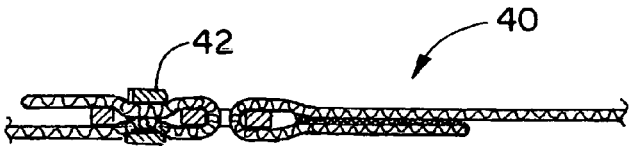
Fig. 5B
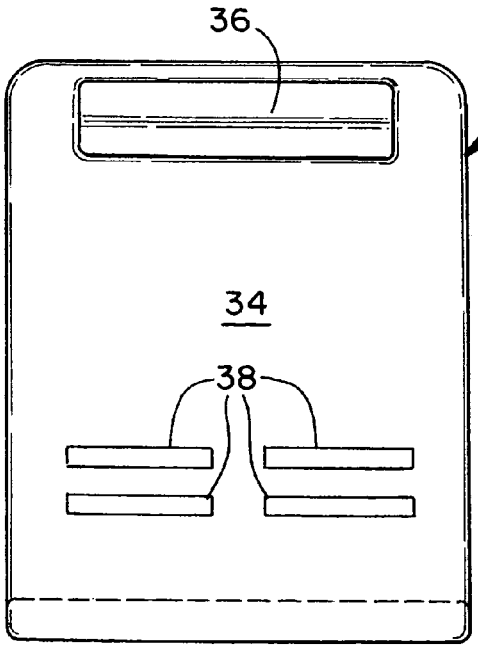
Fig. 6
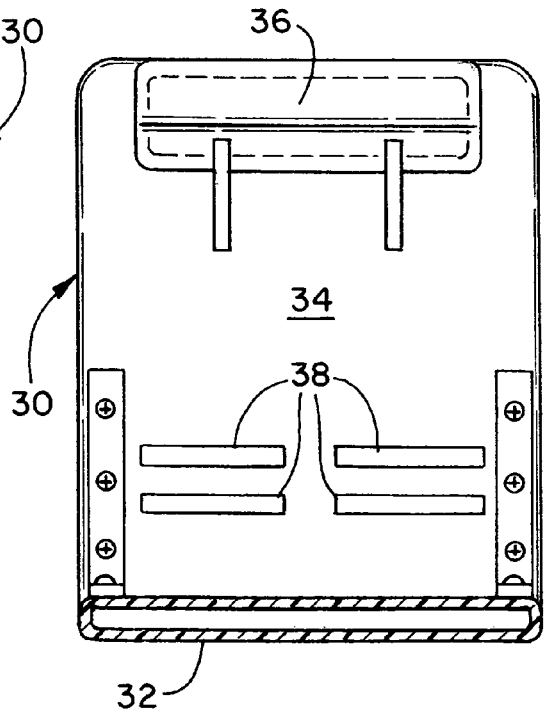
Fig. 7

MATTRESS WITH HAND SUPPORTS

RELATED APPLICATION

The present application is based on, and claims priority to the Applicant's U.S. Provisional Patent Application 60/503,258, entitled "Mattress With Hand Supports," filed on Sep. 16, 2003.

BACKGROUND OF THE INVENTION

1. Field of the Invention

The present invention relates generally to the field of mattresses for hospitals and nursing homes. More specifically, the present invention discloses a mattress having hand supports with hand grips built into the sides of the mattress.

2. Statement of the Problem

Many conventional beds in hospitals and nursing homes are equipped with bed rails to assist the patient with turning in bed, egress from the bed, and entering into the bed. The bed rail also helps to prevent the patient from accidentally falling out of bed. However, there have been a significant number of injuries or deaths associated with conventional bed rails. For example, frail, elderly, or confused patients can become entangled or entrapped between the bed rail and the mattress. There is also a risk that the patient can hook their bed clothes on a protruding handle or transfer bar, which can result in the patient stumbling or falling. Therefore, a need exists for a bed with a hand support that eliminates these risks, but continues to meet the patient's needs for a hand support that is sturdy and well designed from an ergonomic point of view.

3. Solution to the Problem

The present invention addresses these shortcomings by providing a hand support with hand grips that are built into the sides of the mattress. This eliminates the risk of the patient becoming entangled between the hand support and mattress, or of the patient's bed clothes becoming hooked on the hand support. Raised bolsters can be built into the top surface of the mattress adjacent to the lateral edges of the mattress to help prevent the patient from falling out of the bed. This approach may also offer cost advantages over conventional bed rails. Placement of the hand supports and bolsters within the mattress allows efficient filling of the mattress with support foam during the manufacturing process, and eliminates the need to purchase separate bed rails or transfer bars.

SUMMARY OF THE INVENTION

This invention provides a mattress for use in hospital, nursing homes, and the like, that incorporates hand supports with hand grips built into the sides of the mattress. Raised bolsters built into the top surface of the mattress adjacent to its lateral edges help to prevent the patient from falling out of the bed.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 5A is a top plan view of a portion of the strap.

FIG. 5B is a side cross-sectional view of the strap corresponding to FIG. 5A.

FIG. 6 is a side elevational view of the hand support assembly.

FIG. 7 is a vertical cross-sectional view of the hand support assembly taken along line 7—7 in FIG. 9.

DETAILED DESCRIPTION OF THE INVENTION

Figure 1:
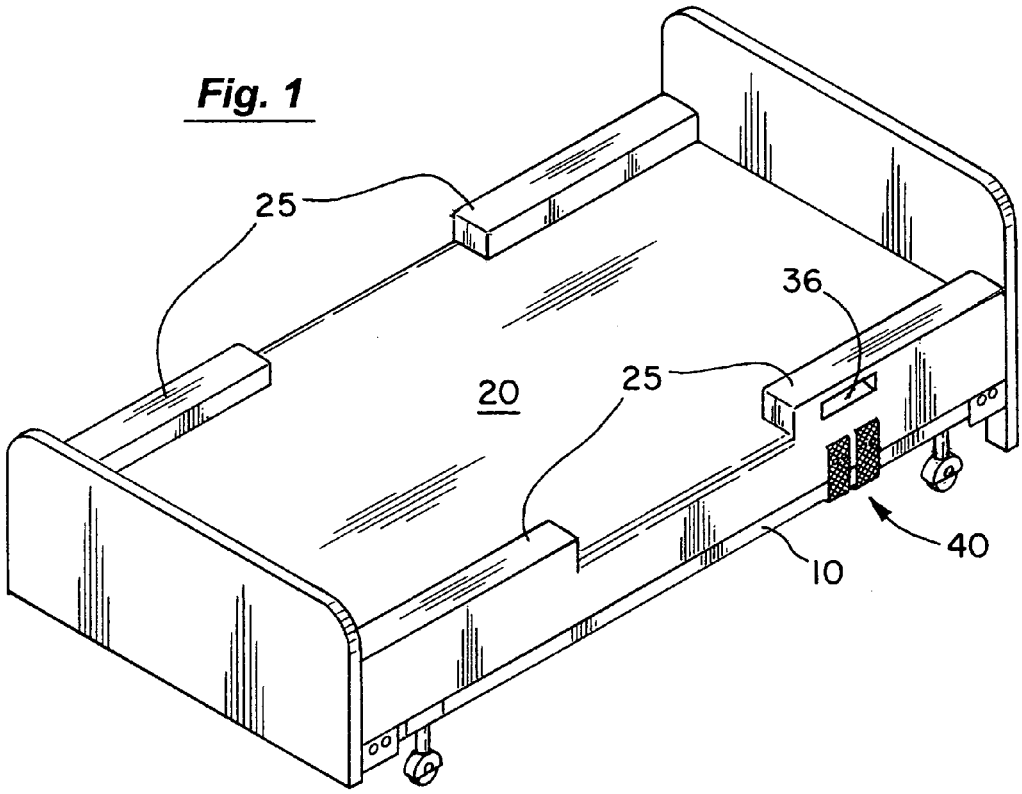
FIG. 1 is a top perspective view of a bed embodying the present invention.
Figure 2:
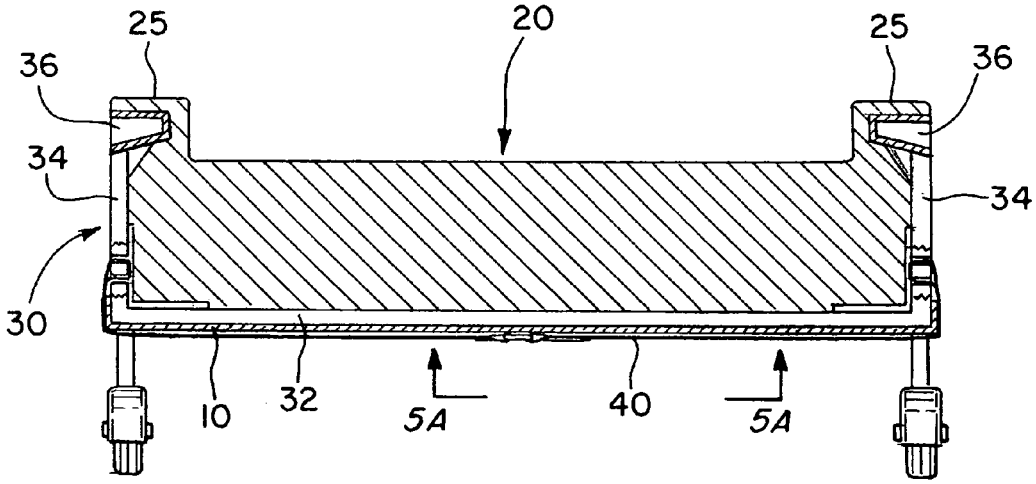
FIG. 2 is a vertical cross-sectional view of the bed corresponding to FIG. 1.

Turning to FIG. 1, a top perspective view is provided of a bed embodying the present invention. FIG. 2 is a vertical cross-sectional view of the bed corresponding to FIG. 1. The major components are a mattress 20 and bed frame 10. The bed frame 10 underlies the mattress and provides a rigid support structure holding the mattress 20 above the floor. The bed frame 10 can include a conventional headboard and footboard. The bed frame 10 shown in the drawings includes a plate that extends beneath and completely covers the bottom of the mattress 20. However, any type of conventional bed frame could be substituted.

The mattress 20 has a resilient core (e.g., foam rubber or coil springs) encapsulated by an outer cover (e.g., a heavy-duty fabric), much like a conventional mattress. Optionally, an internal frame or support structure can be included within the mattress 20. A number of raised bolsters 25 can be built into the top surface of the mattress 20, as shown best in FIG. 1, with an elevation of a few inches above the top surface of the remainder of the mattress 20. These bolsters 25 are preferably placed adjacent to the lateral edges of the mattress 20 to help prevent the patient from falling off either side of the bed 10. For example, a first pair of bolsters 25 can be placed laterally adjacent to the patient's head and a second pair of bolsters 25 can be placed laterally adjacent to the patient's legs, while leaving gaps along the midsections of the lateral edges of the mattress 20 to facilitate ingress and egress by the patient. Alternatively, the bolsters could extend along the entire lateral edges of the mattress. Other arrangements of the bolsters could be readily substituted and should be considered to fall within the scope of the present invention. The bolsters should be somewhat resilient so as to avoid the risk of injury to the patient. For example, the bolsters can be made of blocks of foam rubber that are inserted into corresponding raised pockets in the mattress cover. Alternatively, the mattress 20 and bolsters 25 could be formed as a unitary whole.

Figure 3:
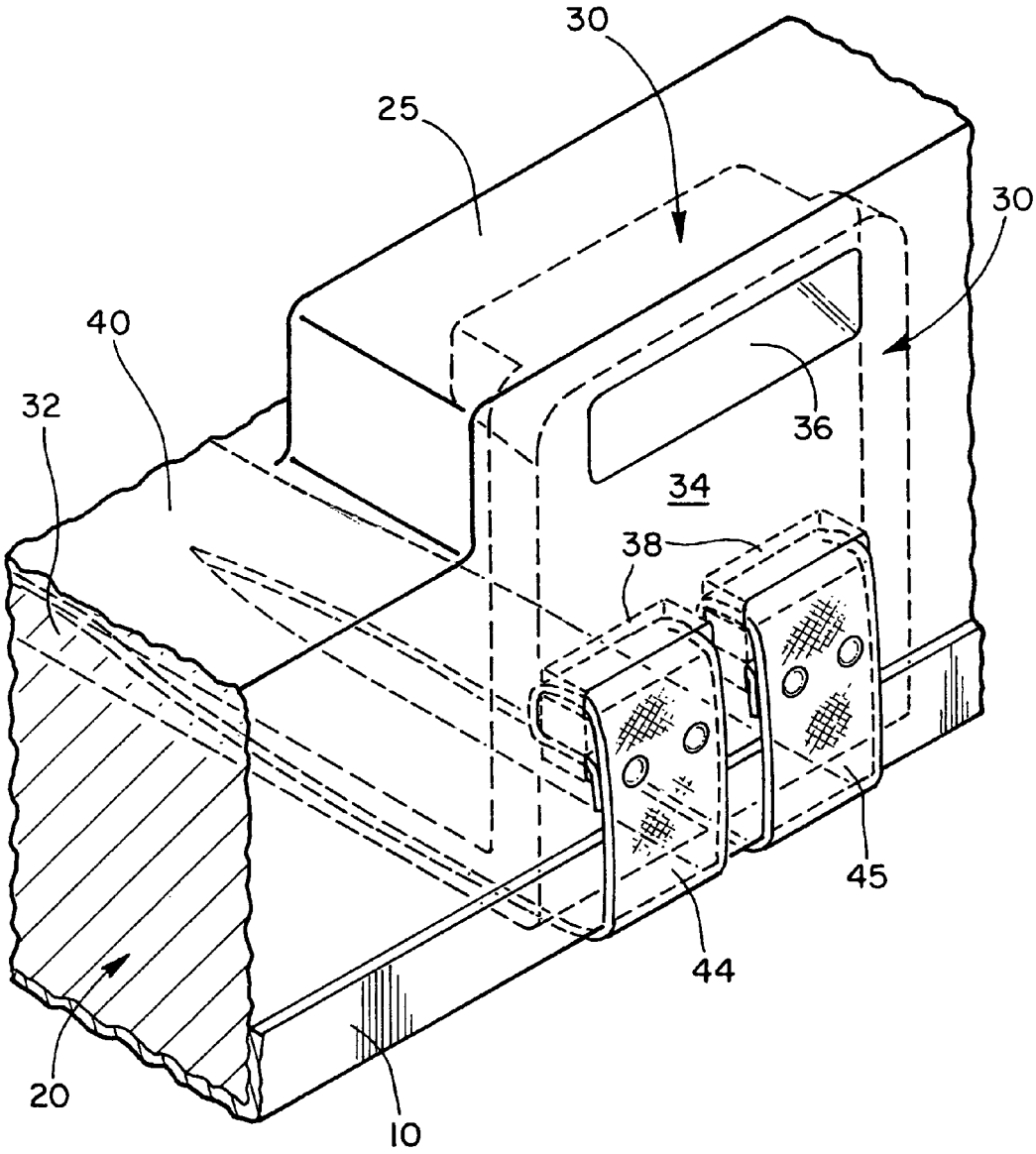
FIG. 3 is a detail perspective view of a portion of a side of the bed showing a hand support.
Figure 4:
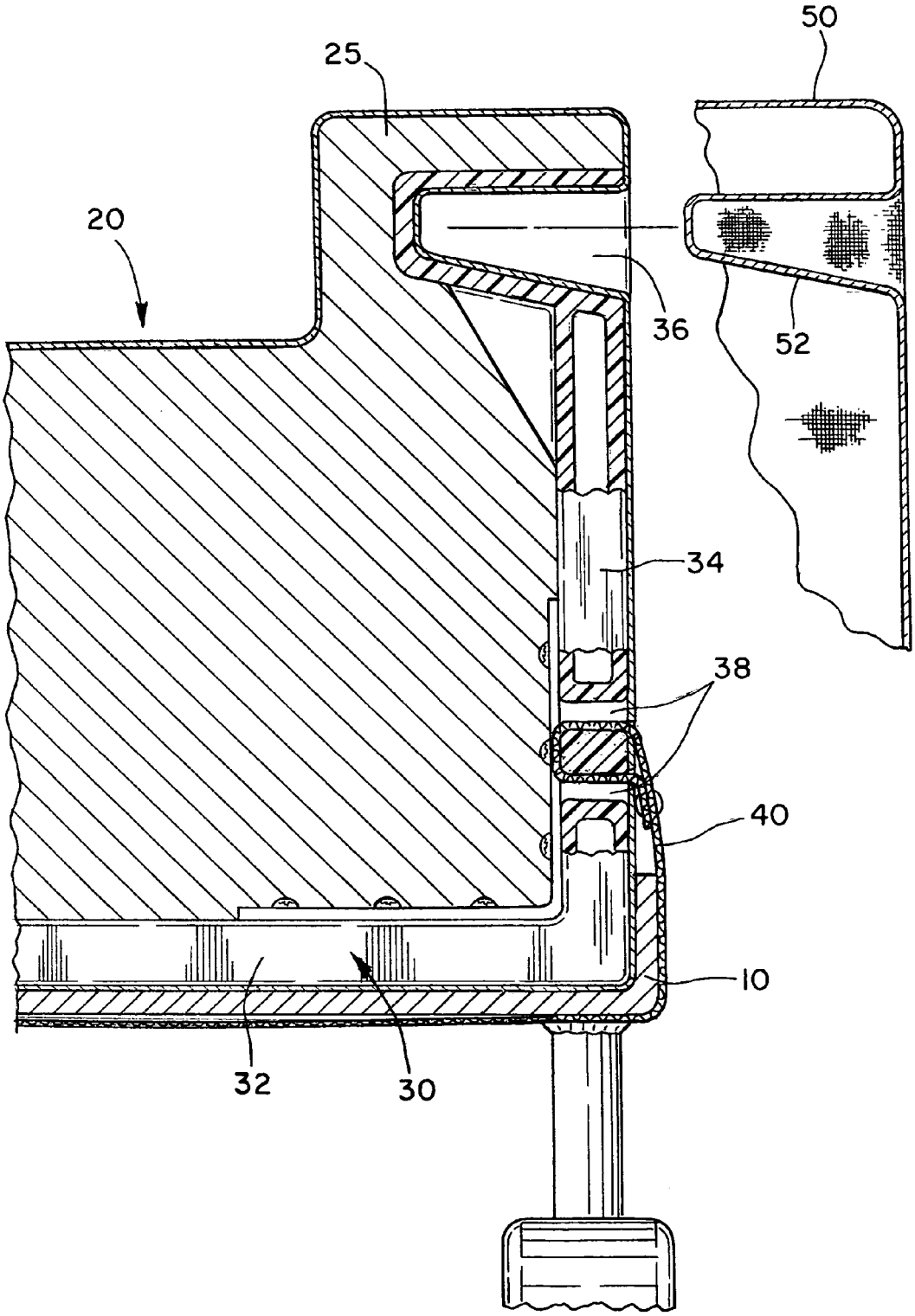
FIG. 4 is a detail vertical cross-sectional view of a portion of the bed.

A number of hand supports 30 are built into the mattress 20. FIG. 3 is a detail perspective view of a portion of a side of the bed 10 showing a hand support 30. FIG. 4 is a detail vertical cross-sectional view of the bed 10 taken through one of the hand supports 30. In the embodiment depicted in the drawings, each hand support 30 includes a horizontal base 32 that extends across the bottom of the mattress 20. Two vertical members 34 extend upward from the ends of the horizontal base, parallel to the side walls of the mattress.

Figure 8:
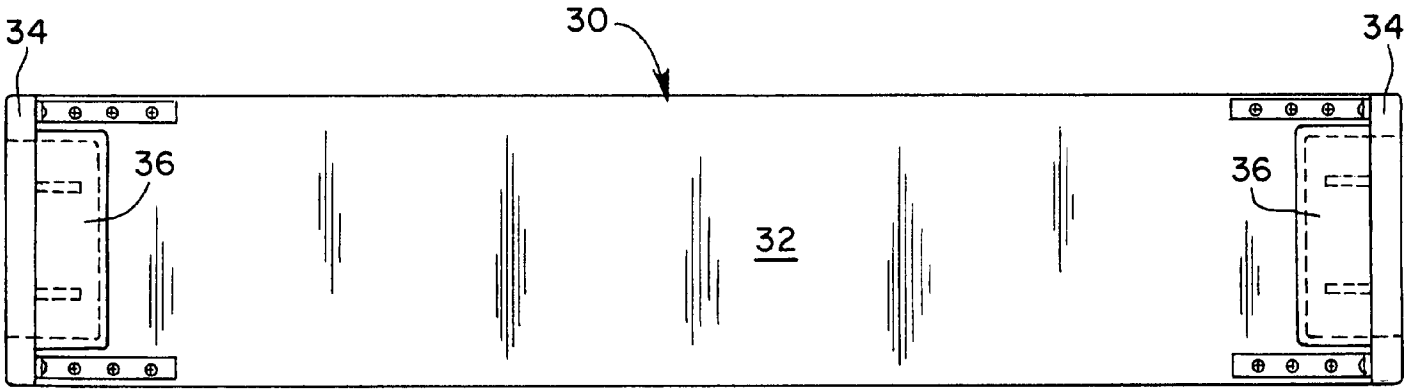
FIG. 8 is a top elevational view of the hand support assembly.
Figure 9:
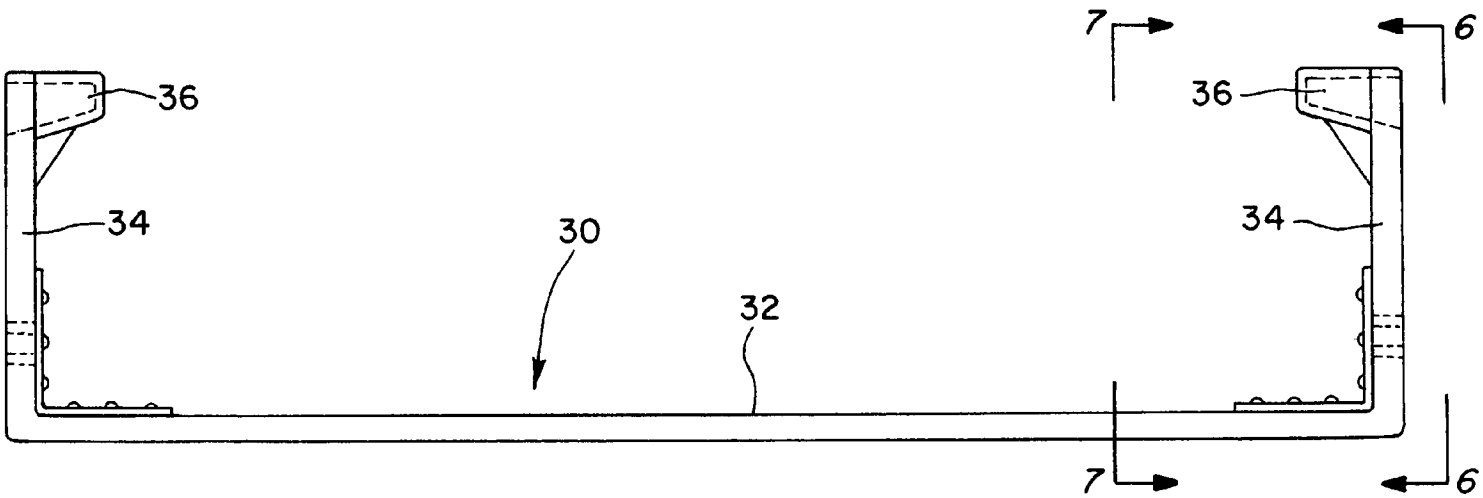
FIG. 9 is a side elevational view of the hand support assembly.

FIG. 8 is a top elevational view and FIG. 9 is a side elevational view of the hand support 30.

Each vertical member 34 includes a hand grip 36 that is recessed into the vertical member 34 and the wall of the mattress 20 as illustrated in FIG. 4. FIG. 6 is a side elevational view of a vertical member 34 and FIG. 7 is a corresponding vertical cross-sectional view taken along line 7—7 in FIG. 9.

The hand supports 30 should have sufficient strength and rigidity to adequately support the weight of the patient. Preferably, the outer surface of the vertical member 34 should be generally flush with the side wall of the mattress 20, so there is no significant gap between the mattress 20 and the vertical member 34 of the hand support 30 that might entangle a patient. Similarly, the vertical members 34 need not extend upward beyond the top of the mattress, so as not to create protrusions that might injure the patient. For example, the hand supports 30 can be placed within the mattress cover so that it becomes an integral part of the mattress assembly.

As illustrated in FIG. 4, a sheet 50 can be fitted over the mattress 20. Optionally, a pocket 52 can be formed in the sheet 50 to accommodate each hand grip 36. Alternatively, slots or openings in the sheets 50 can be used to provide access to the hand grips 36.

Placement of the hand grips 36 on the sides of the mattress 20 is largely a matter of design discretion. Ideally, hand grips 36 should be provided on both sides of the mattress 20 at positions selected to meet the ergonomic requirements of a typical patient. The hand grips 36 should be located so that a patient laying on the mattress can easily reach over the edge of the mattress and grab a hand grip 36 for assistance in shifting the patient's position in the bed, or for assistance in sitting up. The hand grips 36 should also be placed to assist a patient in sitting down on the bed, or in standing up from the edge of the bed. The embodiment shown in FIG. 1 employs only one pair of hand grips 36 near the upper end (or head) of the mattress 20. However, multiple sets of hand grips 36 could be provided. For example, two hand supports 30 can be place on either side of the mid-section of the mattress 20. This configuration provides the patient with two hand grips 36 located on either side of the patient when the patient is seated on the edge of the mattress near its mid-section. It should be understood that the hand grips 36 can also be placed at any convenient elevation on the side wall of the mattress 20. In the embodiment shown in FIGS. 1–4, the lateral surfaces of the bolsters 25 form portions of the sides of the mattress 20 and the hand grips 36 extend into the lateral wall of the bolsters 25. However, the hand grips 36 could readily be placed lower on the sides of the mattress 20.

The corners formed by the horizontal base 32 and vertical members 34 are regions of maximum stress. Therefore, it may be advantageous to reinforce these corners with L-shaped angle brackets, as shown in FIG. 2. The dimensions of these angle brackets are largely a matter of design choice. For example, the angle brackets can be limited to the immediate areas of the corners. Alternatively, the angle brackets can extend upward to reinforce the hand grips 36 as well.

Optionally, a number of straps 40 can be used to secure the mattress 20 and hand supports 30 to the bed frame 10. The strap 40 shown in FIGS. 1–4 extends from one vertical member 34 of the hand support 30 underneath the bed frame to the opposing vertical member 34. This provides stability to the mattress 20 and hand supports 30 to prevent tipping or movement of the mattress 20 in response to forces exerted by the patient on the hand grips 36. The ends of the strap 40 can be inserted through slots 38 in the vertical members 34 of the hand support 30 (shown in FIGS. 6 and 7) and fastened back on themselves with hook-and-loop fasteners, rivets, snaps, or the like, as depicted in FIG. 3. The length and tensioning of the strap 40 can be adjusted by means of a buckle 42 illustrated in FIG. 5A. FIG. 5B is a side cross-sectional view of the strap 40 corresponding to FIG. 5A. As shown in these figures, the ends of the strap 40 can be split into narrower straps 44, 45, as shown in FIGS. 5A and 3, to provide redundancy and allow the use of smaller slots 38 which are less detrimental to the structural strength of the vertical members 34.

The above disclosure sets forth a number of embodiments of the present invention. Other arrangements or embodiments, not precisely set forth, could be practiced under the teachings of the present invention and as set forth in the following claims.

I claim:

1. A mattress assembly comprising:

a mattress having top and bottom surfaces, and opposing lateral sides;

raised bolsters on the top surface of the mattress having lateral surfaces forming portions of the sides of the mattress; and a plurality of hand supports within the mattress, said hand support having:

(a) a horizontal base extending along the bottom of the mattress;

(b) vertical members extending upward from the horizontal base at the sides of the mattress; and (c) hand grips in the vertical members recessed into the lateral surfaces of the bolsters.

2. The mattress assembly of claim 1 wherein the bolsters are laterally adjacent to a patient's head on the mattress.

3. The mattress assembly of claim 1 wherein the bolsters are laterally adjacent to a patient's legs on the mattress.

4. The mattress assembly of claim 1 wherein:

a first pair of bolsters laterally adjacent to a patient's head on the mattress; and a second pair of bolsters laterally adjacent to a patient's legs on the mattress, with gaps between the first and second pairs of bolsters along the midsections of the mattress to facilitate ingress and egress by a patient.

5. The mattress assembly of claim 1 further comprising:

a bed frame supporting the mattress; and a strap extending between the hand supports across the bottom of the mattress beneath the bed frame.

6. A mattress assembly comprising:

a mattress having top and bottom surfaces, and opposing sides; and hand supports within the mattress, said hand support having:

(a) a horizontal base extending across the bottom of the mattress;

(b) vertical members extending upward from the horizontal base at the sides of the mattress; and (c) hand grips in the vertical members recessed into the sides of the mattress.

7. The mattress assembly of claim 6 further comprising raised bolsters on the top surface of the mattress.

8. The mattress assembly of claim 6 further comprising:

a bed frame supporting the mattress; and a strap extending between the vertical members across the bottom of the mattress beneath the bed frame and horizontal member.

9. The mattress assembly of claim 6 further comprising slots in the vertical members for securing the ends of the strap.

10. A mattress assembly comprising:

a mattress having top and bottom surfaces, and opposing lateral sides;

a plurality of hand supports with:

(a) a horizontal base extending along the bottom of the mattress;

(b) vertical members extending upward from the horizontal base at the sides of the mattress; and (c) hand grips in the vertical members;

a first pair of bolsters laterally adjacent to a patient's head on the top surface of the mattress; and a second pair of bolsters laterally adjacent to a patient's legs on the top surface of the mattress, with gaps between the first and second pairs of bolsters along the midsections of the mattress to facilitate ingress and egress by a patient.

11. The mattress assembly of claim 10 wherein the bolsters further comprise lateral surfaces forming portions of the sides of the mattress, and wherein the hand grips are recessed into the lateral surfaces of the bolsters.

12. The mattress assembly of claim 10 further comprising:

a bed frame supporting the mattress; and a strap extending between the hand supports across the bottom of the mattress beneath the bed frame.

13. The mattress assembly of claim 10 wherein the hand grips are recessed into the sides of the mattress.

* * * * *